US007255034B2

(12) United States Patent
Strassgürtl et al.

(10) Patent No.: US 7,255,034 B2
(45) Date of Patent: Aug. 14, 2007

(54) MINE-DETONATION-RESISTANT UNDERSTRUCTURE FOR A VEHICLE

(75) Inventors: Anton Strassgürtl, Schwadorf (AT); Manfred Hermann, Vienna (AT); Gerhard Nittnaus, Gols (AT); Gerhard Skoff, Vienna (AT)

(73) Assignee: Steyr-Daimler-Puch Spezialfahrzeug AG & Co. KG, Vienna (AT)

( * ) Notice: Subject to any disclaimer, the term of this patent is extended or adjusted under 35 U.S.C. 154(b) by 52 days.

(21) Appl. No.: 10/809,294

(22) Filed: Mar. 25, 2004

(65) Prior Publication Data

US 2007/0084337 A1 Apr. 19, 2007

(30) Foreign Application Priority Data

Feb. 18, 2004 (AT) ..... A 250/2004

(51) Int. Cl.
*F41A 25/00* (2006.01)

(52) U.S. Cl. ..... 89/36.08; 89/36.09; 296/193.07

(58) Field of Classification Search ..... 89/36.07, 89/36.08, 36.09; 296/193.07, 204
See application file for complete search history.

(56) References Cited

U.S. PATENT DOCUMENTS

| | | | | |
|---|---|---|---|---|
| 4,664,967 | A * | 5/1987 | Tasdemiroglu | 428/220 |
| 4,928,575 | A * | 5/1990 | Smirlock et al. | 89/36.02 |
| 5,533,781 | A * | 7/1996 | Williams | 296/204 |
| 5,866,839 | A * | 2/1999 | Ohayon | 89/36.08 |
| 6,114,014 | A * | 9/2000 | Ikeda et al. | 428/192 |
| 6,658,984 | B2 * | 12/2003 | Zonak | 89/36.08 |
| 6,779,431 | B2 * | 8/2004 | Honlinger | 89/36.08 |
| 6,782,623 | B1 * | 8/2004 | Gerzeny et al. | 29/897.2 |
| 2005/0121876 | A1 * | 6/2005 | Gaudreau et al. | 280/169 |

* cited by examiner

*Primary Examiner*—J. Woodrow Eldred
(74) *Attorney, Agent, or Firm*—Andrew Wilford

(57) ABSTRACT

An inwardly bend bottom plate, having at least one bending line, is provided on the underside of an armored vehicle body as a protection against mine detonation and can be additionally armored by modular armor plates. Above the bottom plate is a floorboard so spaced therefrom that the dynamic inward buckling of the bottom plate can take place in a deformation space between the bottom plate and the floorboard without injury to an occupant of the vehicle.

16 Claims, 3 Drawing Sheets

MINE-DETONATION-RESISTANT UNDERSTRUCTURE FOR A VEHICLE

FIELD OF THE INVENTION

The present invention relates to A mine-detonation-resistant vehicle pan or bottom structure, hereinafter referred to as an understructure of a vehicle, having an armoring or reinforcement bottom plate.

BACKGROUND OF THE INVENTION

Land mines, because of their high destructive force, have been increasingly used in regions of crisis and in battlefield applications and pose a significant danger to vehicles encountering them and their occupants. Even in the case of peace keeping forces, there is a high probability that vehicles will encounter a mine and it is of considerable interest to be able to provide appropriate armoring for vehicles, especially for vehicles under-structures so as to make them more resistant to mine detonations.

Existing approaches, however, have the drawback that they may increase the weight of the vehicle and thereby making them less maneuverable or decrease the useful load.

While modern vehicles which have been designed to resist mine detonations are less sensitive to the problem and often have their chassis constructions and designs integrated with mine detonation resistant principles, it is nevertheless of interest to provide improved mine detonation blast protection for vehicles.

EP 12 75 928 A2 describes a system in which the entire bottom plate has a concave configuration with a large radius of curvature whose center of curvature lies below the vehicle. Such a configuration of the bottom plate has the advantage of a greater deformation resistance to counteract the explosion pressure of a landmine detonation and precludes some of the danger of buckling of the structure which can occur in an outwardly convex understructure. The drawback of this earlier arrangement is the high fabrication cost of the bottom plate which requires a rolling of high strength armoring steel, the handling of which involves very expensive technology.

OBJECTS OF THE INVENTION

It is the principal object of the present invention to provide a mine-detonation resistant vehicle understructure which can be integrated into an armored vehicle and which can provide improved mine-detonation blast protection and which will have a modular construction with a minimum possible limitation on the useful load and useful space of the vehicle.

Another object of the invention is to provide an improved understructure for a mine-detonation resistant vehicle which will limit the destructive effect of a mine blast and provide improved protection to the interior of the vehicle its occupants.

Still another object of the invention is to provide an understructure for an armored vehicle which has the advantage of the concave bottom plate configuration but which is more economical.

SUMMARY OF THE INVENTION

These objects and others which will become more readily apparent hereinafter are attained, in accordance with the invention in a mine-detonation-resistant vehicle understructure which comprises:

an inwardly bent armored bottom plate mounted on a bottom of a vehicle and convex toward the ground, the bottom plate being formed with at least one bending edge extending longitudinally with respect to the vehicle;

a foot board spaced above the bottom plate and mounted on the vehicle without a direct connection to the bottom plate; and a deformation space formed between the bottom plate and the foot board enabling deformation of the bottom plate toward the foot board as a result of a mine detonation.

With this construction, the inward bulging or further bending of the bottom plate, while permitted within the deformation space, has minimum danger to the occupants of the vehicle, when that bottom plate is mechanically decoupled from the more inwardly lying plate which has been described herein as a footboard to distinguish it from the bottom plate but which also may be armored or composed of reinforcement steel.

The foot plate is not mechanically connected directly with the armored bottom plate therebelow and in addition, is separated from the bottom plate which has one or more bending edges and is bent inwardly and defines the deformation-permitting free space with the footboard.

According to a feature of the invention, the footboard is composed intrinsically of a fragment trapping material or is provided in combination with a fragment trapping material. More particularly, a mine fragment or detonation resistant carpet can be provided on the footboard and can be comprised of a flexible high strength material, for example, a plurality of layers of an aramide fabric as a barrier against passage of fragments into the interior of the vehicle. Any other body armor fragment-trapping material can be used as well. In a feature of the invention, the fragment-trapping carpet can be fastened only at its edges to the footboard or secured to the footboard only at the peripheral edges thereof.

A cover layer for the footboard or the fragment trapping carpet can be comprised of a slip-resistant material, for example, a rubber layer or coating.

The mine-detonation-resistant understructure for a vehicle according to the present invention can have the footboard easily dismountable and connected, for example, to side walls of the understructure by bolts or screws.

Modular additional armoring plates can be mounted as desired or required and for mounting the additional armoring plates, guide rails can be provided on opposite edges along which the additional armoring plates can be slid into place. The additional armoring plates can be secured together by a connecting rail in each of the individual additional armoring plate rows. The additional armoring elements, the guide rails and the connecting bars may have alignable holes in edge regions thereof to receive connecting bolts or screws. In a preferred embodiment, moreover, the connection between the additional armoring elements and the guide and connecting bars may be effected by connecting pins or bolts. The connecting pins can be screws which are threaded into the distal sides of the guide and connecting rails or bars and in any case the connecting pins can be composed of high strength materials. The connecting pins may be fixed by, for example, a threaded device.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
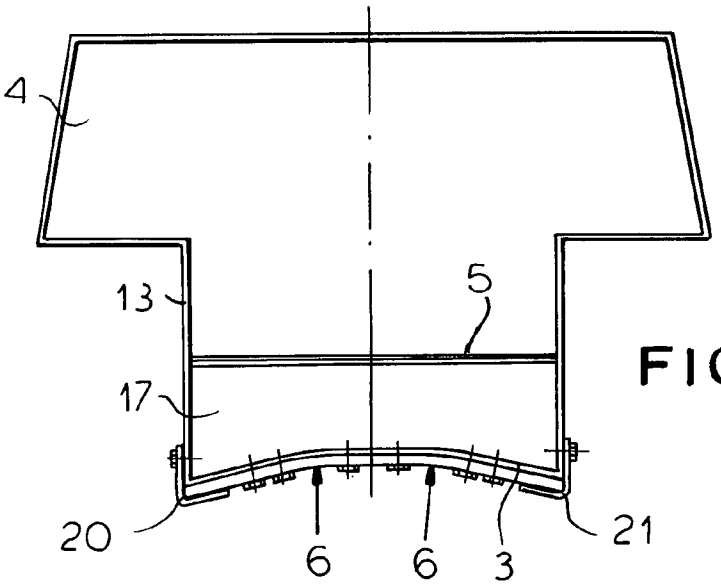
FIG. 2 is a view similar to FIG. 1 of a further embodiment.
Figure 1:
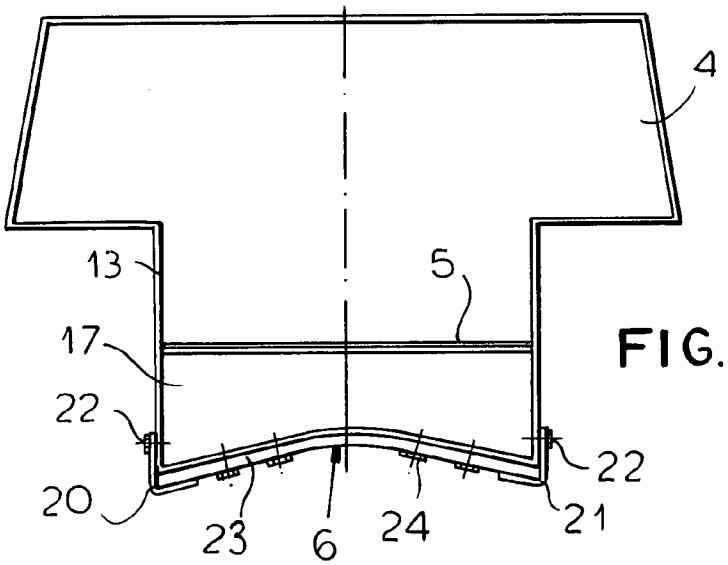
FIG. 1 is a transverse section through an armored vehicle illustrated in highly diagrammatic form and only the outlines of the chassis of which can be seen in this figure.
Figure 11:
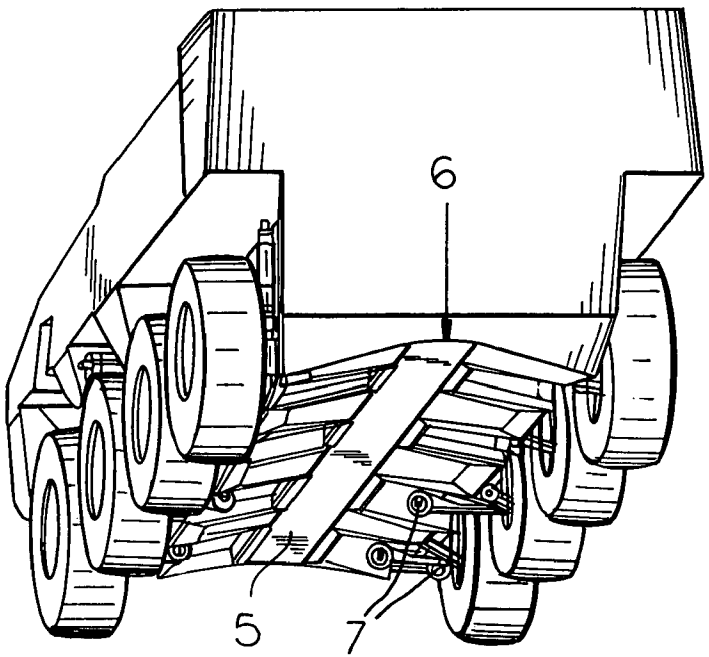
FIG. 11 is a perspective view showing the underside of another armored vehicle embodying the invention.

In FIGS. 1 and 2, we show the understructure of an armored vehicle with a bottom plate of armoring or reinforcement steel 3 having at least one bending edge 6 running longitudinally of the vehicle, i.e. perpendicular to the plane of the paper in FIGS. 1 and 2 and providing the plate 3, hereinafter referred to as the bottom plate, with a large bending radius. Such a bending edge can be economically and simply provided by a bending press. A further advantage of this configuration is the simple integratability of the bottom plate 3 with the wheel suspension parts 7 in the bottom plate structure as has been shown in the perspective view of FIG. 11.

Figure 3:
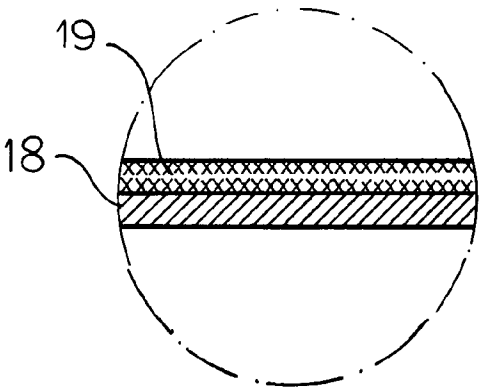
FIG. 3 is a section through the floorboard of the embodiment of FIG. 1 or that of FIG. 2, drawn to a larger scale.

To insure that a dynamic buckling of the bottom plate 3 inwardly will not lead to injury to the occupants of the vehicle, between the vehicle interior and that bottom plate 3, a second plate in the form of a footboard 5 is provided inwardly of the bottom plate 3 and so that between the bottom plate 3 and the footboard 5, a free space 17 is provided. This free space 17, which can be referred to as a deformation free space since it allows inward dynamic buckling of the bottom plate 3 before it contacts the footboard 5, can be greater than that required for the dynamic buckling. The footboard should have no direct contact with the bottom plate 3 so as not to have the dynamic buckling of the plate 3 transfer to the interior of the vehicle. Depending upon the level of protection to be afforded by the footboard 5, the footboard may be ballistically armored as has been illustrated in FIGS. 3 and 4. For example, the footboard 5 may be a sheet metal (armoring steel) plate 18 at its lower side while its upper side can be formed from a technological material 19, for example, an aramide fabric in one or more layers. Any of the fabrics which have been developed for body armor and vehicle armor may be used for this purpose.

Figure 4:
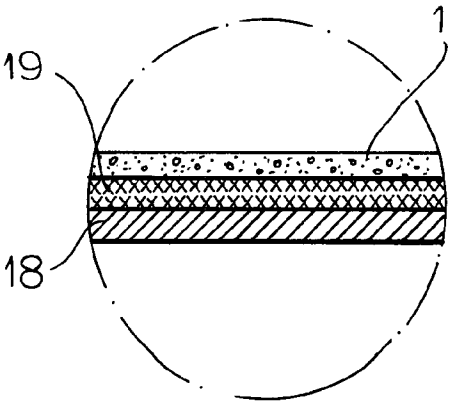
FIG. 4 is a view similar to FIG. 3 illustrating another modification.

In FIG. 4, the combination of materials 18 and 19 can be used together with a slip resistant cover layer 1 which may be composed of rubber containing large amounts of filler.

In a preferred embodiment, an intermediate frame can be provided along the side walls 13 upon which the footboard 5 can rest. In this construction, there is no direct connection between the footboard 5 and the plate 3.

As can be seen in FIGS. 1 and 2, at the junctions between the side walls 13 and the bottom plate, which may be formed with weld seams, weld seam protective strips or structural shapes 20 and 21 are provided. These strips 20 and 21 can be attached by bolting or welding at 22 to the side walls and underlie the bottom plate 3 so that additional armoring plates 23 can be inserted and secured to the bottom plate 3 by pins, rivets or bolts 24. In FIG. 2, two bend lines 6 have been shown.

Figure 6:
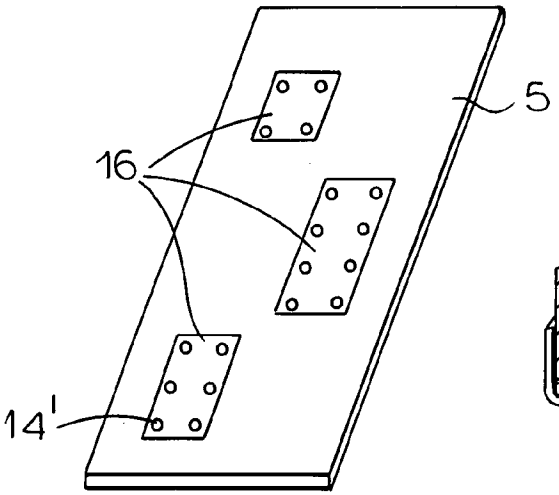
FIG. 6 is a view similar to FIG. 5 providing a view of another floorboard of the present invention.
Figure 5:
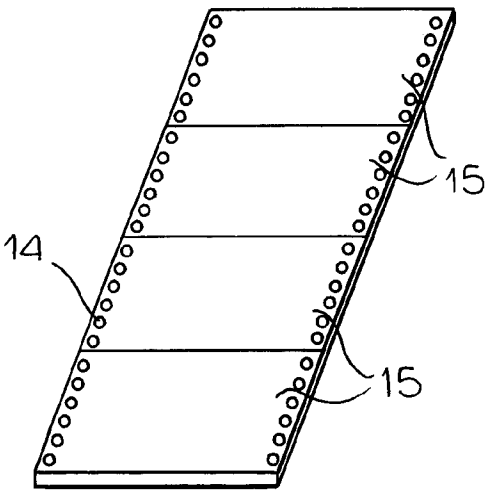
FIG. 5 is a perspective view illustrating the floorboard in accordance with one embodiment thereof.

From FIG. 5 it will be apparent that the footboard can be subdivided into a multiplicity of individual segments which can allow for access to any vehicle components lying there-beneath for maintenance and like purposes. Bolt holes 14 can be provided along the edges 15 in the embodiment of FIG. 6 to allow the segments to be fastened to an underlying rail which can be part of the support frame mentioned previously.

The floorboard 5 can, alternatively, or in combination with the segmented configuration shown in FIG. 5, have a plurality of service covers 16 with holes 14' through which the service covers may be bolted to the footboard. The protective mat of ballistic fabric, preferably multiple layers of aramide fabric, can be applied to the footboard and held in place by any convenient means, e.g. clips or bolts so that that mat can be easily removed for access to the surface covers 16.

Figure 7:
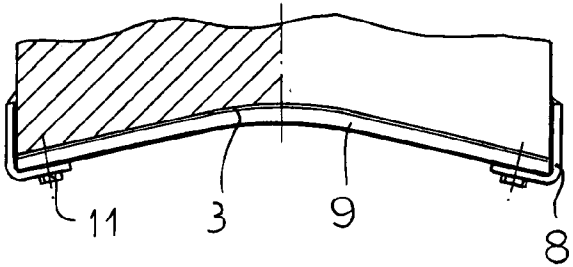
FIG. 7 is a simplified section through the understructure of a tank-type vehicle.

Usually, the armoring against land mine blasts are multilayered structures which require a massive support arrangement which is both heavy and expensive. The support structure and any armoring is usually of steel or a material which has a higher mass effect than steel. In the embodiments of the invention, the individual plates can be secured to the bottom structure of the vehicle in a simple manner as shown so that the more complex armoring of earlier systems can be avoided. FIG. 7 shows, for example, how the guide rails 8 affix to side walls of the understructure can support the bottom plate 3 as well as the additional reinforcing plates 9 which can be attached to the edge strips 8 by the bolts 11. The additional reinforcing elements 9 are here shoved into the guides formed by the rails 8 and are then bolted in place. The plates can be inserted from the front or rear of the vehicle 2. This has the advantage that the additional armoring plates 9 can be made larger than otherwise because they can be more readily handled by several people or with simple lifting devices for alignment with the rails.

Figure 10:
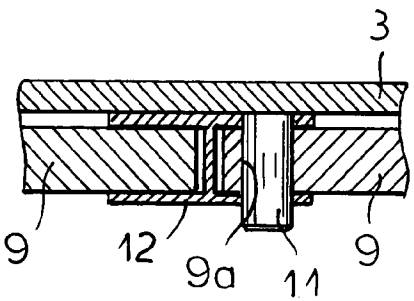
FIG. 10 is another detail in section showing the mounting of additional armoring.
Figure 9:
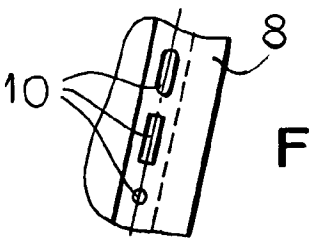
FIG. 9 is a detail illustrating the application of additional armoring.

A further substantial factor for the highest possible blast-resisting effect of the plate elements is their fastening or clamping at the plate edges. Only an efficient edge fastening can so absorb the plate tension forces in the case of a mine-detonation that the inward bowing or buckling is held to a minimum following the detonation of a mine. Especially in the case of additional armoring or reinforcement, it is important that the relatively small plates be held at their edges insufficiently buckling. In the case of the invention, at the edges of the additional reinforcement plates 9, they can be attached to the bottom plate 3 by pins which traverse holes **9*a* in these plates at their edges and which may also traverse aligned holes in the inwardly extending ledges formed by the elements 8 and in the ledges formed by connecting strips 12 between edges of the plates 9 (see FIG. 10). These connecting strips 12 may be provided between plates 9 or along the outer edges below the bottom plate 3** and can be secured to the bottom plate by bolts, screws or pins.

Figure 8:
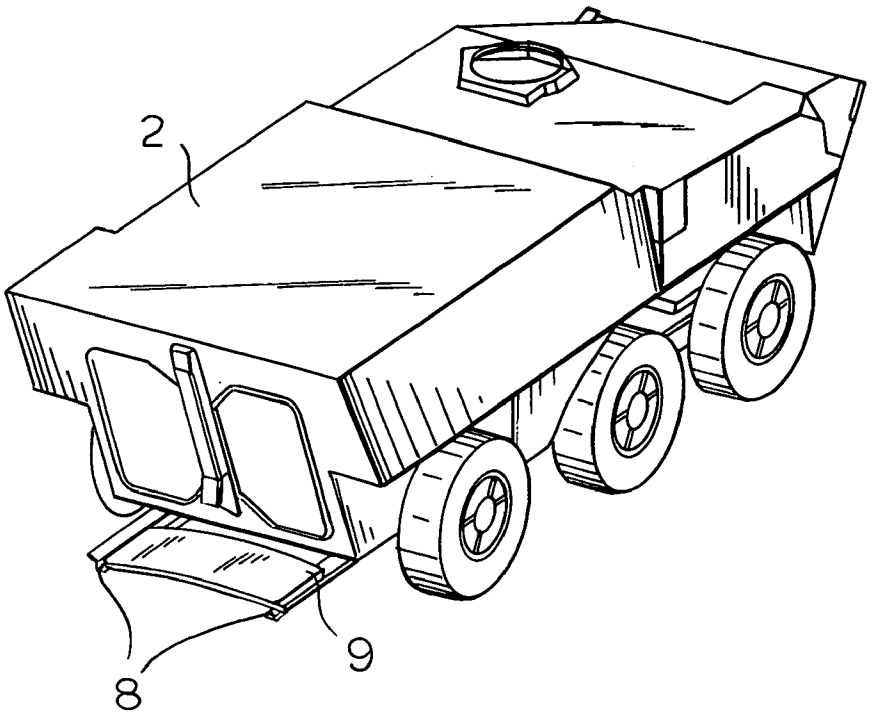
FIG. 8 is a perspective view of a portion of an armored vehicle utilizing the principles of the invention.

In FIG. 8, a plate 9 is shown being inserted along the strips 8.

We claim:

1. A mine-detonation-resistant understructure for a vehicle body, the understructure comprising:

a generally horizontal floor;

a downwardly concave one-piece armoring plate mounted on the body underneath the floor without a direct connection to the floor, concave toward and facing the ground, and spaced below the floor by a distance sufficient to avoid contact with the floor upon buckling of the plate caused by a mine blase underneath the plate, the bottom plate being formed with at least one longitudinally extending bending edge, the armoring plate being wholly formed by a plurality of substantially planar sections or panels interconnected at corners; and a deformation free space formed between the plate and the floor of a height sufficient to permit inward buckling of the plate under a mine detonation without contact of the plate with the floor and substantially free of any force-transmitting structure engaging the floor and plate.

2. The mine-detonation resistant understructure defined in claim 1 wherein the floor is formed at least in part of a material having fragment-trapping properties.

3. The mine-detonation resistant understructure defined in claim 2 wherein the floor is provided with a fragment trapping carpet of a flexible high strength material to prevent incursion fragments into an interior of the body.

4. The mine-detonation resistant understructure defined in claim 3 wherein the carpet is composed of a plurality of layers of an aramide fabric.

5. The mine-detonation resistant understructure defined in claim 3 wherein the carpet is secured to the floor only at edge regions thereof.

6. The mine-detonation resistant understructure defined in claim 2 wherein the floor is provided with a slip-resistant material along an upper surface thereof.

7. The mine-detonation resistant understructure defined in claim 6 wherein the slip-resistant material is a rubber layer.

8. The mine-detonation resistant understructure defined in claim 1 wherein the floor is mounted in the body so as to be easily dismountable.

9. The mine-detonation resistant understructure defined in claim 8 wherein the floor is attached to side walls of the body by screws.

10. A mine-detonation-resistant understructure for a vehicle body, the understructure comprising:

a generally horizontal floor;

a downwardly concave one-piece armoring plate mounted on the body underneath the floor without a direct connection to the floor, concave toward and facing the ground, and spaced below the floor by a distance sufficient to avoid contact with the floor upon buckling of the plate caused by a mine blase underneath the plate, the bottom plate being formed with at least one longitudinally extending bending edge;

a deformation free space formed between the plate and the floor of a height sufficient to permit inward buckling of the plate under a mine detonation without contact of the plate with the floor and substantially free of any force-transmitting structure engaging the floor and plate;

modular armor plate elements mounted along an underside of the plate; and guide rails provided along edges of the plate to receive the modular armoring plate elements.

11. The mine-detonation resistant understructure defined in claim 10, further comprising connecting strips in the form of rails between individual modular armor plate elements.

12. A mine-detonation-resistant understructure for a vehicle body, the understructure comprising:

a main armoring plate bent inward into the body, mounted on the body in juxtaposition with the ground and formed in a longitudinal direction of the vehicle with at least one bending edge;

a floor spaced above the main plate and mounted on the body without a direct connection with the main plate;

a deformation free space formed between the main plate and the floor of a height sufficient to permit inward buckling of the main plate under a mine detonation without contact of the main plate with the floor;

modular armor plates mounted along an underside of the main plate;

guide rails being provided along edges of the main plate to receive the modular armoring plates;

connecting strips in the form of rails between individual modular armor plates; and pins engaging into edge regions of the armor plates and into the connecting strips and the guide rails.

13. The mine-detonation resistant understructure defined in claim 12 wherein the armor plates and the strips and rails have aligned holes to receive the pins.

14. The mine-detonation resistant understructure defined in claim 13 wherein at least some of the pins are screws threaded into the distal sides of the guide rails and connecting strips.

15. The mine-detonation resistant understructure defined in claim 13 wherein the pins are composed of high strength material.

16. The mine-detonation resistant understructure defined in claim 13 wherein the pins are fixed by screw thread devices in holes in the armor plates, the strips or the rails.

* * * * *